US005925288A

United States Patent [19]

Umamori et al.

[11] Patent Number: 5,925,288

[45] **Date of Patent: *Jul. 20, 1999**

[54] ELECTRORHEOLOGICAL FLUID CONTAINING SILICA PARTICLES ESTERIFIED BY AN ALCOHOL-MODIFIED SILICONE OIL

[75] Inventors: Nobuharu Umamori; Mikirou Arai; Makoto Kanbara; Masahiko Hayafune, all of Saitama-ken, Japan

[73] Assignee: Tonen Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/532,845

[22] PCT Filed: Jan. 31, 1995

[86] PCT No.: PCT/JP95/00123

§ 371 Date: Sep. 29, 1995

§ 102(e) Date: Sep. 29, 1995

[87] PCT Pub. No.: WO95/20638

PCT Pub. Date: Aug. 3, 1995

[30] Foreign Application Priority Data

Jan. 31, 1994 [JP] Japan ..... 6/009399

[51] Int. Cl.[6] ..... C10M 171/00; C10M 169/04

[52] U.S. Cl. ..... 252/572; 252/75; 252/78.3

[58] Field of Search ..... 252/78.3, 75, 572

[56] References Cited

U.S. PATENT DOCUMENTS

| | | | |
|---|---|---|---|
| 3,047,507 | 7/1962 | Winslow | 252/75 |
| 3,397,147 | 8/1968 | Martinek et al. | 252/78.3 |
| 4,645,614 | 2/1987 | Goossens et al. | 252/75 |
| 5,266,230 | 11/1993 | Tomizawa et al. | 252/73 |

FOREIGN PATENT DOCUMENTS

| | | |
|---|---|---|
| 1-207396 | 8/1989 | Japan . |
| 1299893 | 12/1989 | Japan . |
| 1304144 | 12/1989 | Japan . |
| 4-348193 | 12/1992 | Japan . |
| 4348193 | 12/1992 | Japan . |
| 5140581 | 6/1993 | Japan . |
| 9303124 | 2/1993 | WIPO . |

OTHER PUBLICATIONS

W.M. Winslow, "Induced Fibration of Suspensions", *Journal of Applied Physics;* vol. 20, Dec. 1949; pp. 1137–1140.

Donald L. Klass et al., "Electroviscous Fluids. I. Rheological Properties", *Journal of Applied Physics;* vol. 38, No. 1, Jan. 1967; pp. 67–74.

Wilmer Duff; "The Viscosity of Polarized Dielectrics", Physical Laboratory, Purdue University, Mar. 1896; pp. 23–38.

*Primary Examiner*—Christine Skane

*Attorney, Agent, or Firm*—Birch, Stewart, Kolasch & Birch, LLP

[57] ABSTRACT

The invention relates to an electrorheological fluid comprising fine silica particles, to which an alcohol-modified silicone oil is bonded, compounded with a nonconducting liquid, to which a polarizing agent is added as necessary. Use of fine silica particles of which the surface is modified by an alcohol-modified silicone oil according to the invention provides an electrorheological fluid which have low initial viscosity, high viscosity increase ratio and excellent dispersion stability.

9 Claims, No Drawings

ELECTRORHEOLOGICAL FLUID CONTAINING SILICA PARTICLES ESTERIFIED BY AN ALCOHOL-MODIFIED SILICONE OIL

FIELD OF THE INVENTION

The present invention relates to an electrorheological fluid. More specifically, it relates to an electrorheological fluid comprising novel surface-modified solid particles dispersed in a nonconducting liquid which have excellent dispersion stability and electrorheological effect.

BACKGROUND OF THE INVENTION

Electrorheological fluids, also called electroviscous fluids, have long been known (see Duff, A. W., Physical Review, 4, (1), 23 (1896)). Early studies were related to pure liquids with poor Theological effects. Later, electrorheological dispersions attracted attention, which resulted in considerable electrorheological effect.

The electrorheological effect was attributed by Klass (Klass, D. L. et al., J. of Applied Physics, 3, (1), 67 (1967)) principally to the induced polarization of the double layers around the dispersed particles in an electric field. The ions adsorbed by the dispersed particles (of silica gel, for example) are uniformly distributed when the external electric field is zero, but are displaced and interact electrostatically with each other when an electric field is applied. Thus bridges are formed by the particles between the electrodes, which is responsible for shear resistance against any stress applied to the fluid, or the electrorheological effect.

Winslow proposed an electrorheological fluid consisting of paraffinic hydrocarbons, silica gel powder, and water as the polarizing agent (Winslow, W. M., J. of Applied Physics, 20, 1137 (1949). This study has prompted to refer to the electrorheological effect as the Winslow effect. Such fluids containing solid particles as the disperse phase have originally had a problem in the dispersibility of the disperse phase, resulting in dense precipitate after a long standing period, or gel formation in several minutes to several hours at temperatures about 100° C., thus losing the function of electrorheological fluid.

Aiming at use in vessels using rubber components, Japanese Patent Application Laid-Open Nos.: 140581/1993, 348193/1992, 299893/1989 and 304144/1989 disclose electrorheological fluids consisting of organopolysiloxanes as the dispersion medium, and fine silica particles surface-modified by specific compounds as the disperse phase. For example, Japanese Patent Application Laid-Open No. 304144/1989 discloses the surface treatment of fine silica particles with either $$X—Si—(OR)_3 \quad (1)$$

or $$(RO)_3—Si—X—Si—(OR)_3 \quad (2)$$

However, surface modification with compounds containing saturated hydrocarbyl, unsaturated hydrocarbyl, aromatic hydrocarbyl or halohydrocarbyl as X in (1) or (2) above does not enhance the affinity of said particles with organopolysiloxanes as the medium, leading to formation of precipitate that cannot easily be redispersed after a long standing period.

1. Disclosure of the Invention

The present invention aims at providing an electrorheological fluid comprising fine silica particles dispersed in a nonconducting liquid, specifically an organopolysiloxane, which have excellent dispersion stability, a low initial viscosity, and enhanced electrorheological effect.

2. Means to solve the Problems

In an attempt to develop electrorheological fluids with such favorable features as stated above, the inventors have found that fine surface-modified silica particles obtained by esterification with an alcohol-modified silicone oil as the disperse phase give an electrorheological fluid with excellent long-term stability of dispersion, a low initial viscosity and enhanced electrorheological effect, thus solving all the problems in the development of electrorheological fluids. The present invention was accomplished on the basis of this discovery.

Thus, the present invention provide an electrorheological fluid comprising a fine silica particles with the surface esterified with an alcohol-modified silicone oil (referred to as "surface-modified fine silica particles" hereinafter) dispersed in a nonconducting fluid.

The invention also provides, as preferred embodiments, electrorheological fluids (1)–(6) below.

(1) An electrorheological fluid in which said nonconducting fluid is a silicone oil, with which surface-modified fine silica particles are compounded, (2) An electrorheological fluid in which said nonconducting fluid is an alkylbenzene and/or a mineral oil, with which surface-modified fine silica particles are compounded, (3) An electrorheological fluid consisting of a nonconducting fluid compounded with surface-modified fine silica particles and a polarizing agent, (4) An electrorheological fluid in which said nonconducting fluid is a silicone oil, with which surface-modified fine silica particles and a polarizing agent are compounded, (5) An electrorheological fluid in which said nonconducting fluid is an alkylbenzene and/or a mineral oil, with which surface-modified fine silica particles and a polarizing agent are compounded, and (6) An electrorheological fluid consisting of a nonconducting fluid compounded with surface-modified fine silica particles which have 0.2 bonds/nm$^2$–8 bonds/nm$^2$ with the alcohol-modified silicone oil.

3. Advantages of the Invention

The electrorheological fluids according to the invention have excellent long-term stability of the dispersion of solid particles, a low initial viscosity, and highly improved electrorheological effect, since the fine silica particles with the surface esterified with an alcohol-modified silicone oil have high affinity with the nonconducting fluid, specifically organopolysiloxanes. These features eliminate problems which have been regarded as inherent to electrorheological fluids and enable long-term, stable applications for electric control systems that respond promptly to external forces in devices under constant vibration, such as variable dumpers and engine mounts.

DETAILED DESCRIPTION OF THE INVENTION

A detailed description of the invention is given below.

The surface-modified fine silica particles in the invention are obtained by esterification of the silanol groups on the silica surface with an alcohol-modified silicone oil, i.e. by dehydration from the silanol groups on the silica surface and the hydroxyl groups in the alcohol-modified silicone oil. The alcohol-modified silicone oil is represented by any of the following generic formulas (1)–(4) below.

General formula (1)

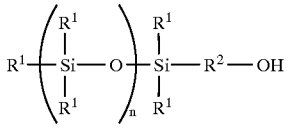

General formula (2)

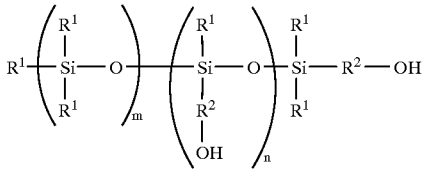

General formula (3)

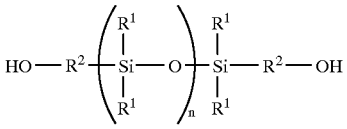

General formula (4)

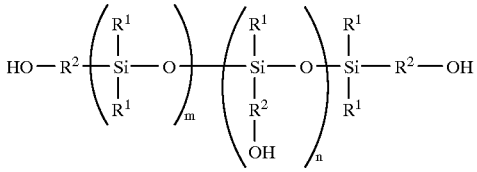

The group $R^1$ in the general formulas (1)–(4) above is hydrogen or a hydrocarbyl group with 1–18 carbon atoms, which may be identical with or different from each other. Such hydrocarbyl groups include alkyl groups with 1–18 carbon atoms, alkenyl groups with 2–18 carbon atoms, cycloalkyl groups with 6–18 carbon atoms, aryl groups with 6–18 carbon atoms, alkylaryl groups with 7–18 carbon atoms, and arylalkyl groups with 7–18 carbon atoms. The hydrocarbyl groups may also contain halogens.

Preferable hydrocarbyl groups as $R^1$ above are those with 1–6 carbon atoms; more preferable groups are alkyl groups with 1–2 carbon atoms.

Preferable examples include alkyl groups such as methyl, ethyl, n-propyl, i-propyl, n-butyl, i-butyl, tert-butyl, n-pentyl, neopentyl, hexyl, heptyl, octyl, nonyl, decyl, and octadecyl; aryl groups such as phenyl and naphthyl; arylalkyl groups such as benzyl, 1-phenylethyl, 2-phenylethyl; alaryl groups such as o-, m- and p-diphenyl; and halogen-containing hydrocarbyl groups such as o-, m- and p-chlorophenyl, o-, m- and p-bromophenyl, 3,3,3-trifluoropropyl, 1,1,1,3,3,3-hexafluoro-n-propyl, heptafluoroisopropyl, and heptafluoro-n-propyl. Particularly favorable as $R^1$ are fluorinated hydrocarbyl groups with 1–8 carbon atoms except for unsaturated aliphatic groups, as well as the methyl group.

The group $R^2$ in the general formulas (1)–(4) above is an alkylene group with 1–18 carbon atoms or an alkylene group containing an ether link, which may be identical with or different from each other in the same molecule. Such alkylene groups should preferably contain 1–12 carbon atoms, or more preferably 1–6 carbon atoms. Examples include ethylene, propylene, butylene, amylene and hexylene groups.

The figures m and n in the general formulas (1)–(4) above represent average degree of polymerization, m being in a range of 0–1,000 and n 1–1,000. In order to obtain electrorheological fluids with large viscosity increase ratios, m and n should preferably be 0–100 and 1–100, respectively, or more preferably 0–50 and 1–50, respectively. For effective viscosity increase and stable dispersion, the values of n should preferably distribute within ±10%, for example n=18–22 or 90–110, the most preferable condition being a compound with a single definite n.

Compounds represented by the general formulas (1)–(4) above may be used singly or as mixture of any two or more. Equally, two or more compounds represented by the same general formula but different values for n and m may be used in mixture. However, use of a single comound is prefered; a compound represented by formula (1) above is particularly preferable.

The alcohol-modified silicone oil, represented by any of the general formulas (1)–(4) above, should preferably have a viscosity of 1 cSt–1,000 cSt, or more preferably 2 cSt–100 cSt, at 25° C. Examples of such silicone oils include Shin-Etsu Chemical's X-22-170B and Toshiba Silicone's TSF4751.

The fine silica particles used in the invention have an average diameter of 0.01 μm–100 μm, or preferably 0.1 μm–10 μm. Examples include colloidal silica, fine silica gel powder, and fine silica sol powder.

The surface-modified fine silica particles used in the invention can be obtained by dissolving an alcohol-modified silicone oil, as represented by any of the general formulas (1)–(4) above, in toluene, benzene or xylene, for example, adding the fine silica particles, heating under reflux, thus reacting while removing water azeotropically.

With respect to 100 parts by weight of fine silica particles, 3 parts–1,000 parts, or preferably 10 parts–300 parts, of the alcohol-modified silicone oil, represented by any of the general formulas (1)–(4) above, can be added for the reaction. The surface-modified fine silica particles thus prepared have 0.2bonds/$nm^2$–8 bonds/$nm^2$ with the alcohol-modified silicone oil. The density of the bonds should preferably be 0.5 bonds/$nm^2$–6 bonds/$nm^2$, or more preferably 1 bonds/$nm^2$–4 bonds/$nm^2$. A bond density of 0.2 bonds/$nm^2$ or less results in poor dispersion with insufficient stability, while 8 bonds/$nm^2$ or more bonds/$nm^2$ diminishes electrorheological effect, although dispersion stability is improved. The bond density can be controlled through the amount of the alcohol-modified silicone oil added and reaction conditions including temperature.

The bond density can be determined by elemental analysis of the reaction product and measurement of the surface area of the particles.

As regards the electrorheological fluids of the invention, it is desirable to contain 0.1 to 50 wt %, and more preferably 3 to 30 wt % surface-modified fine silica particles with respect to the total of the electrorheological fluids, while surface-modified fine silica particles in the amount exceeding 50 wt % deteriorate fluidity of the fluids, resulting in unfavorable reduction of application.

The nonconducting fluid, used as the dispersion medium in the invention, include mineral oils and synthetic lubricating oils, such as paraffin-based mineral oils, naphthene-based mineral oils, poly-α-olefin oils, polyalkyleneglycols, diesters, polyol esters, phosphates, fluorinated oils, silicone oils, alkylbenzenes, alkyldiphenyl ethers, alkylbiphenyls, alkylnaphthalenes, polyphenyl ethers, and synthetic hydrocarbon oils. For dispersion of solid particles, silicone oils, alkylbenzenes and mineral oils are recommended, silicone oils and modified silicone oils being most preferable.

Silicone oils include organopolysiloxanes, such as dimethylpolysiloxane, methylphenylpolysiloxane, diphenylpolysiloxane, m-ethylchlorophenylpolysiloxane, and methylcyanopropylpolysiloxane; modified silicone oils include polyether-, methylstyryl-, alkyl-, ester-, alkoxy-, fluorine-, amino-, epoxy-, carboxyl-, carbinol-, methacryl-, mercapto-, and phenol-modified silicone oils. Either a single substance selected from these or two or more in mixture can be used. The oil should have a viscosity of 1 cSt–500 cSt at 25° C., preferably 1 cSt–100 cSt, or more preferably 3 cSt–50 cSt.

A polarizing agent is added to the electrorheological fluid according to the invention. Polyhydric alcohols and partial derivatives thereof, acids, salts, alkalies, alkanolamines and water are examples of polarizing agents. Polyhydric alcohols are particularly preferable as the polarizing agent. Examples of polyhydric alcohols include dihydric or trihydric alcohols, such as ethylene glycol, glycerine, propanediol, butanediol, pentanediol, hexanediol, polyethylene glycol containing 1–14 ethylene oxide units, a compound represented by the general formula $R[(OC_3H_6)_m OH]_n$, where R is hydrogen or polyhydric alcohol residue, m an integer from 1 to 17, n an ingeter from 1 to 6, or $R—CH(OH)(CH_2)_nOH$, where R is hydrogen or $CH_3(CH_2)_m$ group, m+n being an integer from 2 to 14. Particlularly preferable among them are triethylene glycol, tetraethylene glycol, polyethylene glycol, tripropylene glycol, or a mixture thereof.

Said partial derivatives of polyhydric alcohols include partial derivatives of polyhydric alcohols with at least one hydoroxyl group, such as partial ethers formed by substituting methy, ethyl, propyl, butyl, or alkyl-substituted phenyl (with 1–25 carbon atoms in the alkyl group) group for some of the hydroxyl groups in said polyhydric alcohols, and partial esters formed by esterifying some of the hydroxyl groups with acetic, propionic or butylic acid.

It is desirable to use 1% by weight–100% by weight, or preferably 2% by weight–80% by weight, of such a polyhydric aclohol or its partial derivative with respect to the surface-modified fine silica particles. A concentration less than 1% by weight of the polyhydric alcohol or its derivative lead to insignificant electrorheological effect, while that over 100% by weight result in low electrical conductivity, both being unfavorable effects.

The electrorheological fluids according to the invention may also contain acids, salts or alkalies as necessary. As said acids, inorganic acids such as sulfuric acid, hydrochloric acid, nitric acid, perchloric acid, chromic acid, phosphoric acid or boric acid, or organic acids such as acetic acid, formic acid, propionic acid, butylic acid, isobutylic acid, valeric acid, oxalic acid or malonic acid, can be used. Any salt consisting of a metallic or alkaline residue ($NH_4$+, $N_2H_5$+, etc.) and an acidic residue can be used as said salt. Particularly favorable are those which dissociate when dissolved in polyhydric alcohols and their partial derivatives, such as alkali metal halide and alkaline earth metal halide, which form typical ionic crystals, or alkali metal salts of organic acids. Examples of such salts include LiCI, NaCl, KCl, $MgCl_2$, $CaCl_2$, $BaCl_2$, LiBr, NaBr, KBr, $MgBr_2$, LiI, NaI, KI, $AgNO_3$, $Ca(NO_3)_2$, $NaNO_2$, $NH_4NO_3$, $K_2SO_4$, $Na_2SO_4$, $NaHSO_4$, $(NH_4)_2SO_4$, and alkali metal salts of formic acid, acetic acid, oxalic acid, and succinic acid. As said basic compound, hydroxides of alkali and alkaline earth metals, alkali metal carbonates and amines can be used, which should preferably dissociate when dissolved in polyhydric alcohols and their partial derivatives. Examples include NaOH, KOH, $Ca(OH)_2$, $Na_2CO_3$, $NaHCO_3$, $K_3PO_4$, aniline, alkylamines, and ethanolamine. Said salts and said alkali metals can be used as a mixture.

Other polarizing agents include alkanolamines and water. However, use of water can result in high electric currents.

Said acids, salts, alkalies, alkanolamines and water that enhance polarization can be used in combination with polyhydric alcohols or their partial derivatives. The concentration of such a polarizing agent should preferably be 5% by weight or less of the entire electrorheological fluid; otherwise it may increase power consumption by lower electrical resistivity.

The electrorheological fluids according to the invention may also contain an ashless dispersant as necessary, although said fluids assure satisfactory dispersion of the solid particles. Such a dispersant improves the dispersion and lowers the basic viscosity of the fluid, thus extending the applicability of the fluid to mechanical systems. Examples of the ashless dispersant include sulfonates, phenates, phosphonates, succinimides, amines, and nonionic dispersants; specifically magnesium sulfonate, calcium sulfonate, calcium phosphonate, polybutenylsuccinimide, sorbitane monooleate, or sorbitane sesquioleate can be used, polybutenylsuccinimide being the most favorable. The normal concentration of such a polarizing agent is 0% by weight–20% by weight, or preferably 0.1% by weight–10% by weight, of the entire electrorheological fluid.

The dispersion in the electrorheological fluids according to the invention can further be improved by adding surfactants. Nonionic, anionic, cationic or amphoteric surfactants can be used for this purpose.

Examples of nonionic surfactants include polyoxyethylene alkyl ethers, polyoxyethylene alkylphenyl ethers, polyoxyethylene alkylamides, polyoxyethylene-polyoxypropylene glycol, polyoxyethylene-polyoxypropylene glycolethylenediamine, polyoxyethylene fatty acid esters, polyoxyethylene-polyoxypropylene glycol fatty acid esters, polyoxyethylenesorbitane fatty acid esters, ehylene glycol fatty acid esters, propylene glycol fatty acid esters, glycerine fatty acid esters, pentaerythrit fatty acid esters, sorbitane fatty acid esters, sucrose fatty acid ester and fatty acid ethanolamides.

Anionic surfactants include fatty acid alkali salts, alcohol sulfate salts, polyoxyethylene alkyl ether sulfate salts, polyoxyethylene alkylphenyl ether sulfate salts, fatty acid polyhidric alcohol ester sulfate salts, sulfated oils, fatty acid anilide sulfates, petroleum sulfonates, alkylnaphthalene sulfonates, alkyl diphenyl ether disulfonates, and polyoxyethylene alkyl ether phosphate salts.

The cationic surfactants may be weakly cationic surfactants such as alkylamines and their polyoxyalkylene adducts, including octylamine, dibutylamine, trimethylamine, oleylamine, and stearylamine and its adducts with 5 mol–15 mol ethylene oxide or prolyplene oxide. Other examples of weakly cationic surfactants include alkylenediamines, dialkylenetriamimes and other polyamine-polyoxyalkylene adducts, of which the higher alkyl groups may be substituted, such as ethylenediamine or diethylenetriamine adducts with 0 mol–100 mol ethylene oxide or random or block adducts with 1 mol–100 mol ethylene oxide and 0 mol–100 mol propylene oxide, and oleylpropylenediamine or stearylpropylenediamine adducts with 0 mol–100 mol ethylene oxide. Still further examples of the weakly cationic surfactants are higher fatty acid-polyoxyalkylene adducts, such as oleinamide or stearinamide adducts with 5 mol–15 mol ethylene oxide or 5 mol–15 mol propylene oxide. Strongly cationic surfactants include decanoyl chloride, alkylammonium salts, alkylbenzylammonium salts, alkylbenzylammonium salts and alkylamine salts, such as cetyltrimethylammonium chloride, stearyltrimethylammonium chloride, behenyltrimethylammonium chloride, distearyidimethylammonium chloride, stearyidimethylbenzylammonium chloride, diethylaminoethylstearinamide, coconut amine acetate, stearylamine acetate, coconut amine hydrochloride, and setarylamine hydrochloride. Since strongly cationic surfactants in electrorheological fluids raise the electrical conductivity at temperatures about 100° C., weakly cationic surfactants are preferable to secure low conductivities in a wide temperature range.

The concentration range of such surfactants should be 0% by weight–10% by weight, or preferably 0.1% by weight–5% by weight; a concentration of 10% by weight or more increases the electrical conductivity.

Other additives, such as antioxidants, corrosion inhibitors, friction modifiers, extreme presssure agents, or defoamers, can be added as necessary to the electrorheological fluids according to the invention.

An antioxidant is added to prevent oxidation of the electrorheological fluid and that of the polyhydric alcohol or its partial derivative as the polarizing agent. Antioxidants inactive against the polarizing agent and dispersed phase are recommended; the conventional phenol- and amine-based antioxidant may be used. The phenol-based antioxidants include 2,6-di-tert-butyl-p-cresol, 4,4'-methylene bis(2,6-di-tert-butylphenol), and 2,6-di-tert-butylphenol; and the amine-based ones include dioctyldiphenylamine, phenyl-α-naphtylamine, alkyldiphenylamines, and N-nitrosodiphenylamine. The concentration of the antioxidant should be 0 wt %–10% by weight, or preferably 0.1% by weight–2% by weight, of the entire electrorheological fluid. A concentration of 10% by weight or more results in such problems as unfavorable color, turbidity, sludge formation, or increased consistency of the fluid.

A corrosion inhibitor can also be used which is inactive against the polarizing agent and dispersed phase. Examples of nitrogen-containing corrosion inhibitors include benzotriazole and its derivatives, imidazoline, and pyrmidine derivatives; those containing sulfur and nitrogen include 1,3,4-thiadiazolepolysulfide,1,3,4-thiadiazoryl-2,5-bisdialkyldithiocarbamates and 2-(alkyldithio) benzimidazoles. β-(o-carboxybenzylthio) propionitrile and propionic acid can also be used. The concentration of the corrosion inhibitor should be 0% by weight–10% by weight, or preferably 0.01% by weight–1% by weight, of the entire electrorheological fluid. A concentration of 10% by weight or more results in such problems as unfavorable color, turbidity, sludge formation, or increased consistency of the fluid, as with the antioxidant.

EXAMPLES

The invention is further illustrated in detail in terms of the following examples, which should not restrict the scope of the invention.

Example of synthesis 1

To a solution prepared by dissolving 269 g of an alcohol-modified silicone oil (Shin-Etsu Chemical X-22-170B, kinematic viscosity: 38 cSt at 25° C.) in 300 g of toluene, 30 g of fine silica particles (Fuji Silicia Chemical "Sysilia 310", average particle diameter 1.4 μm) were added. The mixture was then heated under reflux and thorough agitaion for 6 hours to dehydrate azeotropically and esterify. The reaction product was washed with toluene and the silica particles were separated from the mixture in a supercentrifuge (18,000 rpm for 60 min). The washing and separation were repeated until all unreacted alcohol-modified silicone oil was removed. Solvent was removed from the separated silica particles by a rotary evaporator, and 41 g of surface-modified fine silica particles was obtained. The density of bonds on the particle surface with the alcohol-modified silicone oil was 2.5 bonds/nm$^2$.

Example of synthesis 2

An alcohol-modified silicone oil represented by the formula

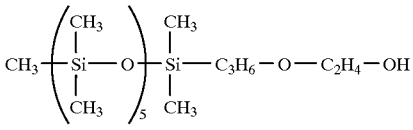

was synthesized, of which 147 g was dissolved in toluene and 30 g of fine silica particles (Fuji Silicia Chemical "Sysilia 310", average particle diameter 1.4μm) were added. The mixture was then heated under reflux and thorough agitaion for 6 hours to dehydrate azeotropically and esterify. The reaction product was washed with toluene and the silica particles were separated from the mixture in an ultracentrifuge (18,000 rpm for 60 min). The washing and separation were repeated until all unreacted alcohol-modified silicone oil was removed. Solvent was removed from the separated silica particles by a rotary evaporator, and 41 g of surface-modified fine silica particles were obtained. The density of bonds on the particle surface with the alcohol-modified silicone oil was 2.5 bonds/nm$^2$.

Example of synthesis 3

A process similar to Example 2 above, except that the heating period for the esterification of the silica particles in the toluene solution of the alcohol-modified silicone oil, gave surface-modified silica particles with a density of bonds on the particle surface with the alcohol-modified silicone oil of 8.5 bonds/nm$^2$.

Example 1

An electrorheological fluid was prepared by dispersing in a silicone oil a mixture of the surface-modified fine silica particles obtained in Example of synthesis 1 above and triethylene glycol. The composition is shown below. The initial viscosity, viscosity increase ratio and dispersion stability of the fluid are shown in Table 1.

| | |
|---|---|
| Surface-modified fine silica particles according to Example of synthesis 1 | 15.0 wt % |
| Silicone oil, kinematic viscosity: 10 cSt at 25° C. (Shin-Etsu Chemical KF-96-10) | 82.0 wt % |
| Triethylene glycol | 3.0 wt % |

Example 2

An electrorheological fluid was prepared at room temperature as a dispersion of the composition shown below. Results of evaluation are shown in Table 1, along with those for the fluids shown in later examples.

| | |
|---|---|
| Surface-modified fine silica particles according to Example of synthesis 1 | 20.0 wt % |
| Silicone oil, kinematic viscosity: 10 cSt at 25° C. (Shin-Etsu Chemical KF-96-10) | 77.0 wt % |
| Triethylene glycol | 3.0 wt % |

Example 3

An electrorheological fluid was prepared at room temperature as a dispersion of the composition shown below.

| | |
|---|---|
| Surface-modified fine silica particles according to Example of synthesis 1 | 15.0 wt % |
| Alkylbenzene, kinematic viscosity: 4.3 cSt at 40° C. | 82.0 wt % |
| Triethylene glycol | 3.0 wt % |

Example 4

An electrorheological fluid was prepared at room temperature as a dispersion of the composition shown below.

| | |
|---|---|
| Surface-modified fine silica particles according to Example of synthesis 2 | 15.0 wt % |
| Silicone oil, kinematic viscosity: 10 cSt at 40° C. (Shin-Etsu Chemical KF-96-10) | 82.0 wt % |
| Triethylene glycol | 3.0 wt % |

Example 5

An electrorheological fluid was prepared at room temperature as a dispersion of the composition shown below.

| | |
|---|---|
| Surface-modified fine silica particles according to Example of synthesis 2 | 20.0 wt % |
| Silicone oil, kinematic viscosity: 10 cSt at 25° C. (Shin-Etsu Chemical KF-96-10) | 77.0 wt % |
| Triethylene glycol | 3.0 wt % |

Example 6

An electrorheological fluid was prepared at room temperature as a dispersion of the composition shown below.

| | |
|---|---|
| Surface-modified fine silica particles according to Example of synthesis 2 | 15.0 wt % |
| Alkylbenzene, kinematic: viscosity: 4.3 cSt at 40° C. | 82.0 wt % |
| Triethylene glycol | 3.0 wt % |

Example 7

An electrorheological fluid was prepared by dispersing in a silicone oil a mixture of the surface-modified fine silica particles obtained in Example of synthesis 3 above and triethylene glycol. The composition is shown below.

| | |
|---|---|
| Surface-modified fine silica particles according to Example of synthesis 3 | 15.0 wt % |

-continued

| | |
|---|---|
| Silicone oil, kinematic viscosity: 10 cSt at 25° C. (Shin-Etsu Chemical KF-96-10) | 82.0 wt % |
| Triethylene glycol | 3.0 wt % |

Example of synthesis 4

Silica particles 0.1 μm in average diameter was prepared by grinding in a ball mill for 6 hours a mixture of 60 g of silica particles (Fuji Silicia Chemical "Sysilia 310", average particle diameter 1.4gm) and 200 g of toluene, to which 200 g of oleyl alcohol ($C_{18}H_{35}OH$) was added and reacted by heating to 111° C. for 6 hours under reflux to dehydrate azeotropically. The reaction product was washed with carbon tetrachloride, and the particles were separated by an ultracentrifuge (18,000 rpm for 60 min). The washing and separation were repeated until all unreacted alcohol was removed. Carbon tetrachloride was removed from the separated silica particles by a rotary evaporator, and 37 g of fine silica particles esterified with oleyl alcohol were obtained. The density of bonds on the particle surface with oleyl alcohol was 3.0 bonds/$nm^2$.

Example of synthesis 5

Aqueous solution (A) was prepared by adding gradually 2.8 g of 3-glycidoxypropyltrimethoxysilane

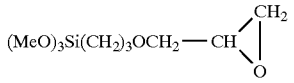

and a solution of 1.2 g of 3-aminopropyltriethoxysilane ($H_2N(CH_2)_3Si(OE_t)_3$) in 7.2 g of water to 40 g of silica particles (Fuji Silicia Chemical "Sysilia 310", average particle diameter 1.41 μm), and aqueous solution (B) were prepared by dissolving 35 g lithium acrylate, 80 g acrylamide and 1.5 g methylenebisacrylamide in 200 g of water. Solution A was gradually to solution B under agitation, to which 0.4 mg ammonium persulfate and 0.2 ml tetraethylethylenediamine. The mixture obtained was agitated for 3 hours in liquid paraffin at 40° C. The product obtained was filtered, washed with hexane and toluene, and dried to give fine powder.

Comparative Example 1

A reference electrorheological fluid was prepared at room temperature as a dispersion of the composition shown below.

| | |
|---|---|
| Surface-modified fine silica particles according to Example of synthesis 4 | 15.0 wt % |
| Silicone oil, kinematic viscosity: 10 cSt at 25° C. (Shin-Etsu Chemical KF-96-10) | 82.0 wt % |
| Triethylene glycol | 3.0 wt % |

Comparative Example 2

A reference electrorheological fluid was prepared at room temperature as a dispersion of the composition shown below.

| | |
|---|---|
| Surface-modified fine silica particles according to Example of synthesis 4 | 20.0 wt % |
| Silicone oil, kinematic viscosity: 10 cSt at 25° C. (Shin-Etsu Chemical KF-96-10) | 77.0 wt % |
| Triethylene glycol | 3.0 wt % |

Comparative Example 3

A reference electrorheological fluid was prepared at room temperature as a dispersion of the composition shown below.

| | |
|---|---|
| Surface-modified fine silica particles according to Example of synthesis 5 | 20.0 wt % |
| Silicone oil, kinematic viscosity: 10 cSt at 25° C. (Shin-Etsu Chemical KF-96-10) | 77.0 wt % |
| Triethylene glycol | 3.0 wt % |

The initial viscosity, viscosity increase ratio and separation tendency of the electrorheological fluids prepared in Examples 1–7 and Comparative Examples 1–3 were measured as follows.

The viscosity was measured by a double-cylinder rotation viscometer at 40° C. under a constant shear rate (628 $sec^{-1}$). The initial viscosity was obtained as the viscosity without applying voltage. Then the viscosity was measured under application of 1 kV AC between the inner and outer cylinders, and the viscosity increase ratio was calculated as its ratio to the initial viscosity. The separation tendency was evaluated by letting the specimen in a graduated measuring cylinder stand for 3 months and determining the thickness ratio (%) of the upper transparent layer and the whole specimen. The results are summarized in Table 1 below.

The results for Examples and Comparative Examples demonstrate that the electrorheological fluids according to the invention has low initial viscosities, high viscosity increase ratios, and excellent dispersion stability as represented by the separation tendency.

TABLE 1

| | Initial Viscosity (cP) @ 40° C. | Viscosity increase ratio @ 1 KV/mm | Separation tendency (%) (after 3 month-standing) | Precipitate (%) (after 3 month-standing)* |
|---|---|---|---|---|
| Example 1 | 9 | 7 | 0 | 0 |
| Example 2 | 15 | 6 | 0 | 0 |
| Example 3 | 12 | 7 | 0 | 0 |
| Example 4 | 11 | 16 | 0 | 0 |
| Example 5 | 17 | 12 | 0 | 0 |
| Example 6 | 13 | 1.1 | 0 | 0 |
| Example 7 | 22 | 4.5 | 0 | 0 |
| Comparative Example 1 | 82 | 2.5 | 18 | 0 |
| Comparative Example 2 | No flowing | — | — | — |
| Comparative Example 3 | 48 | 2.2 | 25 | 10 |

*Precipitate is material that has been settled in the bottom of the cylinder containing the sample after 3 months of standing. The value was determined as the thickness ratio (%) of the portion that does not flow on tilting the cylinder and the whole sample.

We claim:

1. An electrorheological fluid comprising at least one non-conducting fluid selected from the group consisting of an organopolysiloxane, an allylbenzene, a poly-α-olefin, a diester, a polyol ester and a mineral oil, which is compounded with 0.1% by weight to 50% by weight, based on the entire electrorheological fluid, of fine silica particles esterified by an alcohol-modified silicone oil, said fine silica particles having 0.2 bonds/$nm^2$ to 8.5 bonds/$nm^2$ with the alcohol-modified silicone oil.

2. An electrorheological fluid as claimed in claim 1 above, in which said non-conducting fluid is a silicone oil.

3. An electrorheological fluid as claimed in claim 1 above, in which said non-conducting fluid is an alkylbenzene and/or a mineral oil.

4. An electrorheological fluid as claimed in claims 1 above with a polarizing agent added to said non-conducting fluid.

5. An electrorheological fluid as claimed in claim 4 above, in which said polarizing agent is a polyhydric alcohol.

6. An electrorheological fluid as claimed in claims 1 above, in which said alcohol-modified silicone oil is one or more compounds represented by the general formulas (1)–(4) below:

General formula (1)

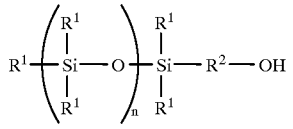

General formula (2)

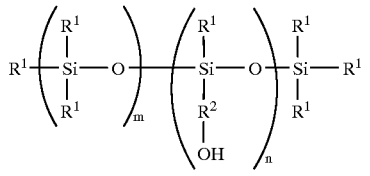

General formula (3)

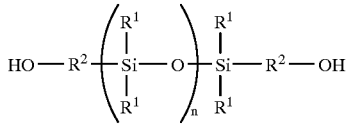

General formula (4)

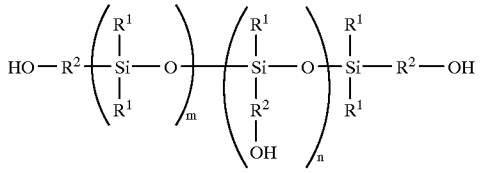

where $R^1$ is hydrogen or a saturated or unsaturated hydrocarbyl group with 1–18 carbon atoms, $R^2$ an alkylene group with 1–18 carbon atoms, m an intger from 0 to 1,000, and n an integer 1 to 1,000.

7. An electrorheological fluid as claimed in claim 1 above, in which said fine silica particles have an average diameter of 0.1 to 10 microns.

8. An electrorheological fluid as claimed in claim 1 above, in which said fine silica particles have 0.5 bonds/$nm^2$ to 6 bonds/$nm^2$ with the alcohol modified silicone oil.

9. An electrorheological fluid as claimed in claim 1 above, in which said fine silica particles have 1 bond/$nm^2$ to 4 bonds/$nm^2$ with the alcohol modified silicone oil.

* * * * *